US007128439B2

(12) United States Patent
Winsor

(10) Patent No.: US 7,128,439 B2
(45) Date of Patent: Oct. 31, 2006

(54) MULTI-USE PLANAR PHOTOLUMINESCENT LAMP AND METHOD OF MAKING SUCH LAMP

(75) Inventor: Mark Winsor, Chehalis, WA (US)

(73) Assignee: Winsor Corporation, Chehalis, WA (US)

( * ) Notice: Subject to any disclaimer, the term of this patent is extended or adjusted under 35 U.S.C. 154(b) by 177 days.

(21) Appl. No.: 10/747,003

(22) Filed: Dec. 23, 2003

(65) Prior Publication Data

US 2005/0135080 A1 Jun. 23, 2005

(51) Int. Cl.
*H01J 65/04* (2006.01)
*G09F 13/26* (2006.01)

(52) U.S. Cl. ..... 362/267; 313/288; 313/607

(58) Field of Classification Search ..... 362/267; 313/607, 634, 288, 292; 40/545; 326/267
See application file for complete search history.

(56) References Cited

U.S. PATENT DOCUMENTS 905,468 A * 12/1908 Shearer ..... 40/572
1,396,245 A * 11/1921 Boettcher ..... 40/572
1,612,645 A * 12/1926 Nooe ..... 40/572
1,851,335 A * 3/1932 Taliaferro ..... 40/572
1,915,511 A * 6/1933 Banse ..... 40/572
1,984,215 A * 12/1934 Hotchner ..... 313/609
2,555,749 A * 6/1951 Krefft ..... 313/493
2,730,644 A * 1/1956 Michlin ..... 313/498
2,769,263 A * 11/1956 Wamser ..... 40/572
3,030,540 A * 4/1962 Mash ..... 313/505
3,037,137 A * 5/1962 Motson ..... 313/502
3,153,745 A * 10/1964 Gurian et al. ..... 362/84
3,238,407 A * 3/1966 Jaffe ..... 313/502
3,344,269 A * 9/1967 Brown ..... 362/84
3,508,103 A * 4/1970 Young ..... 313/493
4,138,620 A * 2/1979 Dickson ..... 362/84
4,266,164 A * 5/1981 Schroeder ..... 362/98
4,647,337 A * 3/1987 Simopoulos et al. ..... 313/502
4,851,734 A * 7/1989 Hamai et al. ..... 313/607
5,067,063 A * 11/1991 Granneman et al. ..... 362/84
5,475,574 A * 12/1995 Chien ..... 362/84
5,754,003 A * 5/1998 Murai et al. ..... 313/634
6,246,169 B1 * 6/2001 Pruvot ..... 313/506
2002/0117959 A1 * 8/2002 Winsor ..... 313/607

* cited by examiner

*Primary Examiner*—Sandra O'Shea
*Assistant Examiner*—Ismael Negron
(74) *Attorney, Agent, or Firm*—Seed IP Law Group PLLC

(57) ABSTRACT

A planar photoluminescent lamp includes a plurality of glass spacer beads affixed to a first glass plate, and a second glass plate in contact with the glass spacer beads. The glass plates are hermetically sealed to form a chamber, which is filled with a selected gas. Transparent electrodes are placed on the exterior of the first and second glass plates, over which electrically insulating layers are extended. First and second semi-transparent decorative layers are laid over the insulating layers, out of which light is transmitted. One or more transparent insulating layers extend over transparent electrodes placed on the exterior surface of the first and second glass plates.

17 Claims, 3 Drawing Sheets

MULTI-USE PLANAR PHOTOLUMINESCENT LAMP AND METHOD OF MAKING SUCH LAMP

TECHNICAL FIELD

This invention relates to planar photoluminescent lamps, and more particularly, to a two-sided planar photoluminescent lamp having two glass plates forming a chamber which stores a gas to emit light by fluorescent phenomena.

BACKGROUND OF THE INVENTION

Thin, planar, and relatively large area light sources are needed in many applications. Because of low light transmission in typical active matrix liquid crystal displays (LCD), very thin and powerful backlights are required to preserve a thin profile and readability in high ambient lighting conditions. Incandescent lamps or LEDs create local bright or dim spots because of the nature of point light sources. Additionally, significant heat dissipation in incandescent lamps or LEDs restrict practical use to low output conditions. Electroluminescent lamps suffer from having relatively low brightness, and are therefore only suitable for low light display outputs.

Recent advances in photoluminescent technology have met the demand for a thin, lightweight, planar lamp having a substantially uniform and durable display. One such fluorescent lamp is described in U.S. patent application Ser. No. 09/796,334. The lamp comprises a pair of glass plates connected by a sidewall, thereby creating an open chamber which contains a gas and photoluminescent material. Electrodes are placed on the outside of the glass plates to create an electric field inside the chamber, which ionizes the gas and causes the photoluminescent material to emit visible light.

Current photoluminescent lamps allow transmission of light through only one glass plate. A reflective coating is provided on the interior of the bottom plate, to guide additional light through the top glass plate. The top electrode may be patterned as a grid on the exterior surface of the plate using a silver-based compound. Thus, the existence of the reflective coating on the bottom surface is in part necessary to counteract the light attenuation by the top electrode.

Because the reflective coating restricts the use of such current lamps to one-sided light output, there remains a need for a two-sided, thin, lightweight lamp with substantial and uniform physical integrity across the entire surface.

SUMMARY OF THE INVENTION

According to principles of the present invention, a photoluminescent lamp and a method of producing such a photoluminescent lamp is provided. In one embodiment, a gas-filled photoluminescent lamp contains a plurality of glass spacer beads affixed to a first planar glass plate at selected locations in a pre-determined pattern, and a second glass plate in loose contact with the plurality of glass beads. A plurality of adhesive pads are placed onto the first glass plate to affix the glass spacer beads to the plate. The adhesive pads may be composed of an adhesive binder mixed with a glass bearing a lower melting point as compared to the melting point of the first glass plate and the plurality of glass spacer beads. Sidewalls create a hermetic seal with the two glass plates, to form a chamber that is filled with a gas. The lamp contains first and second transparent electrodes on the outside of the glass plates, and transparent electrically insulating layers extending over the electrodes. Finally, a semi-transparent decorative layer is positioned over the surface of one of the insulating layers.

In another embodiment, the lamp may further contain structurally supportive layers over each of the electrically insulating layers to provide rigidity and adaptability of the lamp. Such supportive layers provide the benefit of easily replacing the external decorative layer(s) without stripping the device down to the insulative layers, but rather sliding a decorative layer in or out of a sleeve on the exterior of the lamp.

In one embodiment, the invention may be used as a two-sided advertising display, or alternatively as a one-sided display. In a two-sided embodiment, a second semi-transparent decorative layer is placed over the second insulating layer. The lamp may also be used as a source of general lighting. Due to the thin profile of the lamp and the ability to have any desired surface area size or shape, it is functional for general lighting for counters under a cupboard, for boat galleys, can lights, or other low profile locations, to name a few uses.

The method of creating the multi-use photoluminescent lamp comprises the steps of affixing a plurality of adhesive pads to a first glass plate, placing a plurality of glass beads in contact with the first glass plate, and moving the beads along the surface of the plate such that the glass beads adhere to the adhesive pads. Once the excess glass spacer beads are discarded, the combination of materials is treated to affix the spacer beads to the first glass plate. A second plate is placed into loose contact with the glass spacer beads, and is affixed to the first plate with a hermetic seal. The atmosphere is evacuated from the chamber between the two plates, and the chamber is filled with a selected gas. Finally, first and second electrodes extend over the exterior of the glass plates.

In one embodiment, the step of treating the combination of materials involves heating them to a temperature higher than the melting point of the glass in the adhesive pads to melt out the adhesive binder and thus fuse the beads to the glass plate.

DETAILED DESCRIPTION OF THE INVENTION

Figure 1:
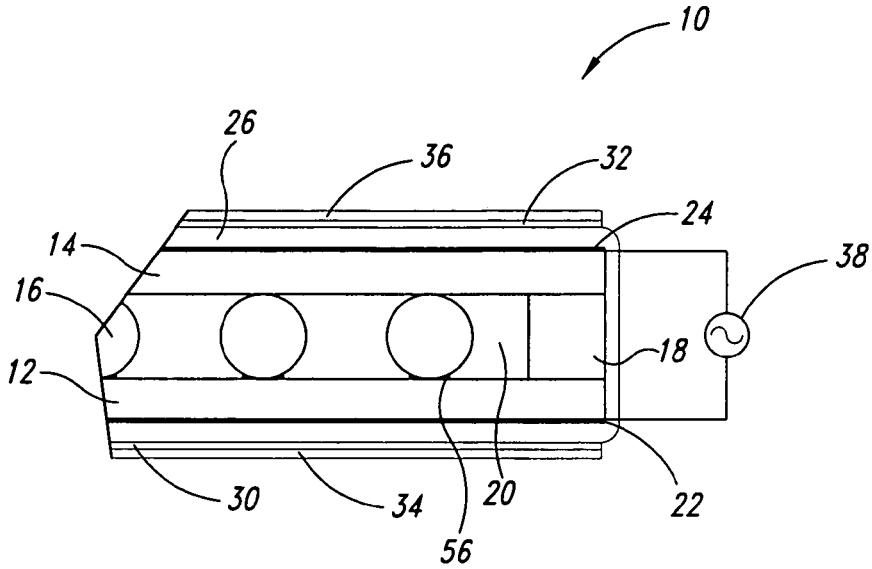
FIG. 1 is a fragmentary cut-away schematic of the invention in cross-section.

FIG. 1 illustrates a lamp 10 having a bottom glass plate 12 and a top glass plate 14 connected by a sidewall spacer 18 to create a hermetically-sealed chamber 20. The chamber 20 contains an ultraviolet emissive gas such as mercury vapor in a noble gas environment, which in one embodiment may comprise xenon, argon, and the like. Although mercury vapor is frequently used in fluorescent lamps, it is possible to use other materials and gases instead of mercury vapor, such as krypton, argon, xenon, a mixture of inert halogen gases and the like, either alone or in combination to produce the desired spectral characteristics, all of which are known to those of skill in the art. Additionally, it is permitted to vary the lamp pressure to alter the spectral characteristics of the lamp for a given gas. Furthermore, it is possible to use photoluminescent materials other than phosphors to generate visible light energy in response to excitation by UV radiation. Accordingly, the present invention is not limited by the lamp pressure, the type of photoluminescent material, or type of gas used to fill the lamp.

The bottom glass plate 12 and top glass plate 14 are separated by a plurality of glass spacer members 16. In one embodiment, the spacer members 16 are beads that are UV transmissive glass beads and have a diameter selected to match the height of the sidewall spacer 18. Spacer members 16 made of glass allow UV light generated in the chamber 20 to pass through the spacers relatively unimpeded and thus reduce undesirable dim spots in the lamp 10. In one embodiment, the spacer members 16 can be standard glass beads such as those made from Boro-silicate glass. Glass beads of this type are widely available for a very low cost in large bulk. For example, beads of this type are used in paint stripes on the road to increase the reflectivity.

According to the invention, it is preferred to pass the bulk beads through successive screens or mesh filters to remove all beads larger or smaller than 0.5 mm and those beads which are not round. The spacer members 16 are distributed uniformly across the chamber 20 so as to provide support for the faces of the plates 12, 14 at a height equal to the sidewall spacer 18. The chamber is very thin, in the range of 0.3 mm to 2 mm, thus providing light from a very thin lamp. In one embodiment, the height of the sidewall spacer 18 and equivalent diameter of the spacer members 16 is 0.5 mm. It is preferred that the spacer members 16, in the form of beads, are uniform in diameter and precisely spherical in nature, so that the orientation of the beads on the spacers does not matter and so that uniform stress is placed on the glass plates 12, 14 at points in contact with the spacer members 16. The screen or meshes can be selected to have a desired tolerance level to obtain a selection of balls that are uniform with respect to each other within desired parameters.

In an alternative embodiment, other shapes are used for spacer members 16. For example, cylindrical rods running approximately the length of the chamber and being a diameter of 0.5 mm can be used. Also, the spacer members may be columns, cones, pyramids, cubes or the like.

Figure 3:
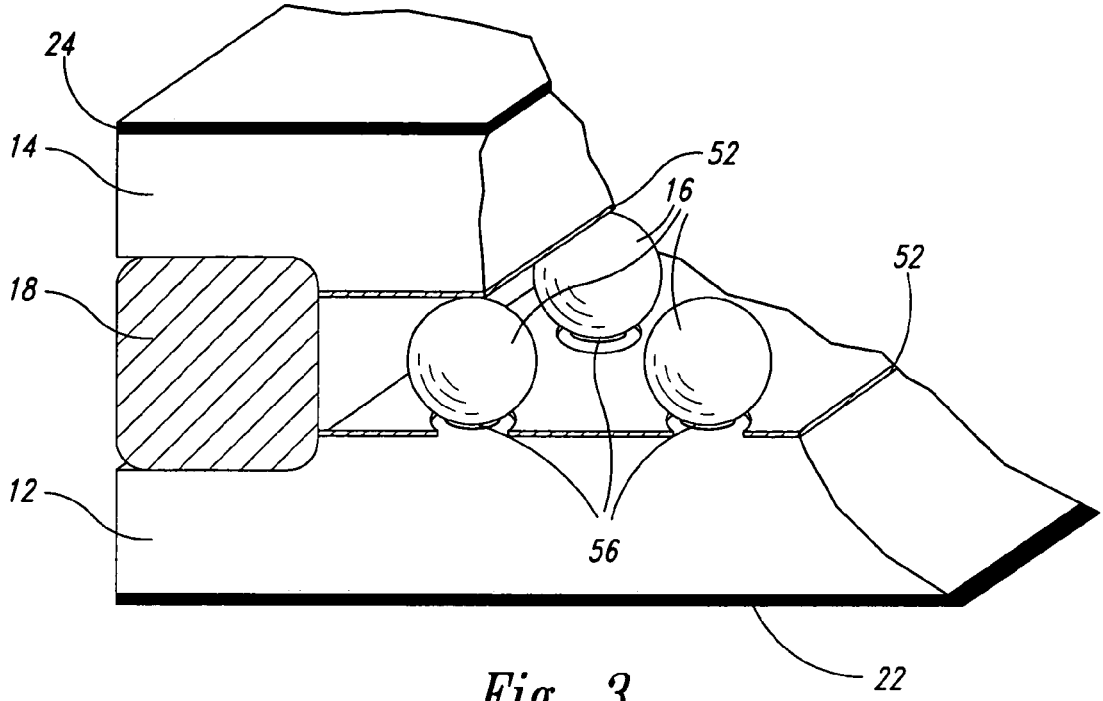
FIG. 3 is a fragmentary cut-away cross-sectional view of a planar lamp according to one embodiment of the invention.

As also shown in FIG. 3, the glass spacer members 16 are affixed to the bottom glass plate 12 by adhesive pads 56. The pads 56 may be a mixture of glass and adhesive material and/or a binder. The glass has a melting point lower than that of the glass plates 12, 14 and the glass spacer members 16 to allow later treatment of the pads to melt the glass of the pads to affix the spacer members 16 to the glass plate 12 without changing the shape of the beads.

A bottom transparent electrode 22 and top transparent electrode 24 are on exterior surfaces of the plates 12, 14. The electrodes 22, 24 are coupled to opposite sides of an alternating current power supply 38, or alternatively one electrode to an AC power supply and the other to ground, or as a further alternative, pulsed DC could be used. The electrodes 22, 24 are used to create an electric field by capacitive coupling through the dielectric of the plates 12, 14. This produces a stable and uniform plasma from the ultraviolet emissive gas in the chamber 20. The plasma acts as a uniform source of ultraviolet light, which is a condition conducive to uniform visible light generation.

Bottom and top transparent electrodes 22, 24 are designed to permit light to exit the chamber 20 through the glass plates 12, 14. The electrodes 22, 24 may be a transparent coating on the glass plates as to permit light to pass through without causing undesirable gradations in the produced illumination. Such transparent electrodes are known in the art and any of the many commercially known and used electrodes are acceptable. In an alternate embodiment, the electrodes 22, 24 may comprise conductive lines patterned as a grid on the exterior surface of the plates 12, 14 using a laser or ultraviolet (UV) light and an aqueous development process to yield highly conductive lines of a silver-based compound. However, a transparent electrode layer over the exterior of the glass plates 12, 14 is preferred because it allows minimal light gradation.

A transparent insulating layer 26 covers the bottom and top electrodes 22, 24. The insulating layer 26 may be standard commercial grade silicone, and in one embodiment has a thickness of approximately 0.75 mm. In another embodiment, the thickness of silicone layer 26 is less than 0.1 mm, such as 0.05 mm or less. Thickness is the range of 1 mm to 0.01 mm.

The insulating layer 26 may be mixed with a high molecular weight polymer, such as polydimethylsiloxane, and may be applied by any acceptable technique, including, for example, rolling on layers of silicone, spraying, screen printing, dipping the electrodes into the silicone, or the like. As shown in FIG. 1, the layer extends over the exterior of sidewall spacer 18, but it will be appreciated that the insulating layer 26 may be separated to form two distinct and separate layers over bottom and top electrodes 22, 24. In one embodiment of the invention, the insulating layer 26 is selected to be a material that remains stable and does not degrade over long periods of time when subjected to UV light.

In one embodiment, structurally supportive layers 30, 32 extend over the insulating layer 26 on both the bottom and top of the device. Such a layer may be comprised of Mylar®. The bottom and top structurally supportive layers 30, 32 provide additional integrity to the device as well as adaptability for convenience of the user. In one embodiment, one or both of the outermost decorative layers (described below) may be easily replaced by the user without stripping the device down to the insulating layer 26, a benefit made possible because of the intermediate structurally supportive layers 30, 32.

Semi-transparent decorative logo layers 34, 36 are provided on the exterior of the lamp. Such layers contain a pattern of a semi-transparent colored material capable of transmitting light through the layer from within the lamp 10. Typically, the decorative logo layers 34, 36 are easily removable, and may be held in place by a retaining rim 60 (see FIG. 4). The layers 34 and 36 may be approximately 30% thicker than the structurally supportive layers 30, 32 and are thick enough to hold the color or print of a design or advertisement. The printed text on the logo may make the layer thicker. In one embodiment, the decorative logo layers 34, 36 are semi-transparent and comprise advertising images silk-screened onto a supportive backing. In the use of the lamp 10 as a one-sided light source or sign (see below), only one semi-transparent decorative logo layer 34 is necessary.

It will be appreciated that the present invention may be modified for use as a one-sided lamp, whereby a reflective coating such as $TiO_2$ or $Al_2O_3$ may be deposited on the exterior surface of the bottom glass plate 12 so that more light is reflected out the top glass plate 14 and none out the bottom glass plate 12. Additionally, white plastic or some other backing may be applied to one side to enhance the light emanating from the other side of the lamp. This would permit the lamp to be used for general lighting purposes, such as for down lighting such as can lighting, under counter lighting, task lighting, kitchen counter lighting or other specialty lighting applications where the thin profile of the lamp would permit its use where other lamps can't be used. It is a low profile, flat lamp that has a total thickness, all coatings included, of about ¼ of an inch or less. In ships, submarines and other small space environments, this flat lamp will be beneficial in overcoming typical limitations on the thickness of lamps due to space concerns.

The ability to maintain the integrity of the sealed chamber 20 provided by the bottom glass plate 12 and top plate 14 is in part a function of the thickness of the plates 12, 14, the arrangement and number of the spacer members 16, and net atmospheric pressures. The net atmospheric pressure is the difference between external and internal pressure of the chamber 20. The glass of the plates 12, 14 must be thick enough to withstand external atmospheric pressure exerted against portions of the plates that are not supported by the spacer members 16 to prevent implosion of the lamp 10. In one embodiment, bottom glass plate 12 and top glass plate 14 have an approximate thickness of 1 mm. In one embodiment, standard architectural glass of the type used in standard glass windows is used for plates 12 and 14. It is preferred to be annealed glass, of a standard type, that is low cost. A soda lime silicate glass, also known as float glass, is preferred. A thickness in the range of 2–3 millimeters is preferred, but other thicknesses are acceptable. A standard glass of low cost is preferred since this will permit the lamp to be produced in high quantities at a low cost. The glass not need to be tempered glass, but can be used if it desired and available in the desired shape and size. Because of the importance of physical integrity, it is beneficial if the spacer members 16 are positioned in a uniform pattern between the bottom and top glass plates 12, 14.

Figure 2:
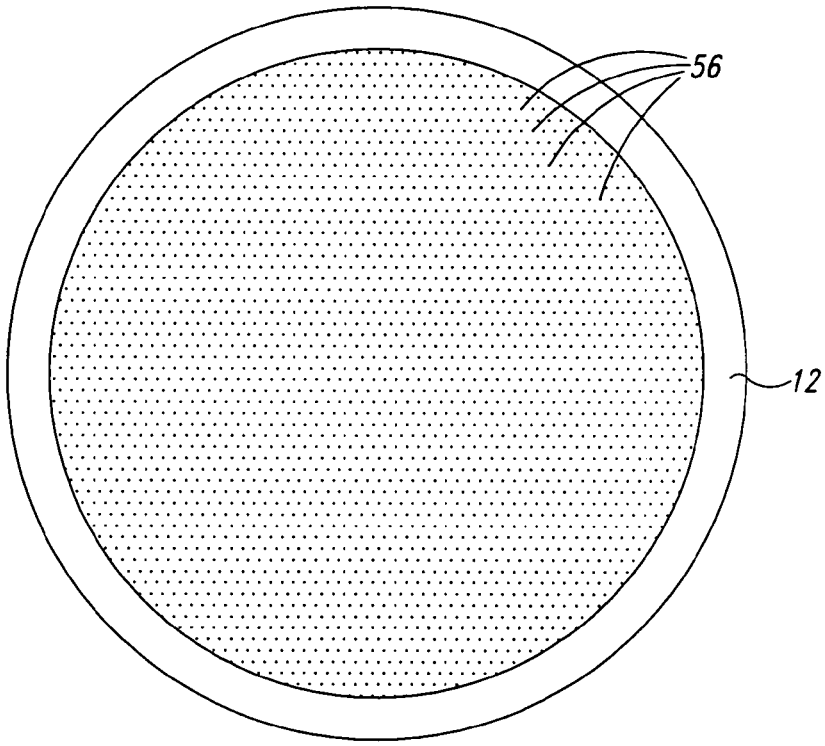
FIG. 2 is a top plan view of an example of the patterning of the glass bead spacers.

FIG. 2 shows the placement of adhesive pads 56 that, in one embodiment, are screen-printed onto the bottom glass plate 12. The surface of the bottom glass plate 12 is shown at an intermediate stage of manufacture. The adhesive pads 56 may be circular in shape and approximately 0.15–0.25 mm in diameter. The pads 56 are uniformly spaced and may be separated at their centers by a distance of 2 to 6 mm, but there is no strict requirement. It is desired that they are adequately spaced to allow room for the spacer members 16 to affix to the glass plate 12. The number and pattern of pads 56 are selected to ensure proper support of plates 14 and 12 but to not be so numerous or dense to reduce the light output of the lamp. In one embodiment, the size of the adhesive pads 56 is selected such that no more than one glass spacer member 16 is able to affix to each pad 56. However, in another embodiment, multiple glass spacer members 16, such as beads, may be affixed to a single pad 56 without affecting the functionality of the invention.

To apply the glass spacer members 16 onto the adhesive pads 56, a plurality of glass spacer members 16 are poured over the glass plate 12 and adhesive pads 56. The number of spacer members 16 may be many more than the number of adhesive pads 56 to ensure that each dot can have at least a single spacer member 16. The adhesive pads 56 bind the glass spacer members 16 in place, and the additional spacer members 16 that do not connect to a pad are discarded from the plate 12.

If the pads 56 contain a glass, the plate 12 and beads are then heated to a temperature just above the melting point of the adhesive pads 56, yet below the melting temperature of the glass plate 12 and the glass bead spacer members 16. This process drives the adhesive binder material out of the adhesive pads 56 and fuses the glass in the pads 56 to both the glass spacer members 16 and corresponding surface of the glass plate 12. This process melts only the adhesive pads 56 because, as described above, the melting point of the pads 56 is lower than the spacer members 16 and glass plate 12. The top glass plate 14 is then placed on top of the beads during manufacture and attached by the sidewall spacer 18, but is not affixed to the glass spacer members 16.

The loose contact between the second glass plate 14 and glass spacer members 16 allows the insertion of gas into the chamber 20 to take place without placing great strain on the glass plates 12, 14. Because top glass plate 14 is left unfused to the glass spacer members 16, the glass plates 12, 14 are allowed to flex and bend during the evacuation and refill process. To fill the chamber 20 with gasses, it is first necessary to evacuate the air from the chamber 20. Once the sidewall spacer 18 creates a hermetic seal between the glass plates 12, 14, steps are taken to evacuate atmospheric gasses from the chamber 20, fill the chamber 20 with an ultra-violet emissive gas, and seal the chamber 20.

FIG. 3 is a fragmentary cutaway view of the lamp 10 according to one embodiment illustrating the constituents of the chamber 20, the plates 12, 14, and the electrodes 22, 24. A top and bottom phosphor layer 52 is a layer of rare earth phosphors and $Al_2O_3$ that is applied to the exposed surface of the bottom and top glass plates 12, 14. In one alternative, a phosphor layer of rare earth phosphors similar in thickness and composition to the top and bottom phosphor layer 52, may be applied to a portion of the interior surface of the sidewall spacer 18 that intervenes between the bottom glass plate 12 and top glass plate 14.

The glass spacer members 16 are affixed directly to the bottom glass plate 12 via adhesive pads 56. The bottom phosphor layer 52 has been applied to the bottom glass plate 12, leaving holes in the layer 52 at locations where adhesive pads 56 are to be positioned. The layer 52 may be applied using a mask, which keeps the phosphor layer 52 from covering the glass plate 12 in the positions where the adhesive pads 56 are to be located. A reverse mask of the phosphor layer may be used when applying the adhesive pads 56 to the glass plate 12.

One sequence for manufacturing the decorative lamp according to the present invention is as follows. The bottom glass plate 12 and the top plate 14 both have a phosphor layer 52 placed on the surfaces thereof. The phosphor coating on the top plate 14 is an unbroken coating, done without a mask while the phosphor coating on the bottom glass plate 12 will usually be done with a mask having openings where the spacer beads are to be affixed to the bottom glass plate 12. The phosphor layer is then dried and cured to be stable. The phosphor layer may have a binder therein to assist in sticking to the glass and to the spacer members 16. After the phosphor layer is on the glass plate 12, adhesive pads 56 are placed on the glass using a screen print process. They are positioned within the openings of the phosphor layer. This can be done by using a reverse mask of that used for the phosphor layer or a new mask can be provided having openings slightly smaller than but aligned with the openings provided in the phosphor layer 52. The adhesive pads therefore directly contact the glass plate 12.

A large number of spacer members 16, such as in the form of beads, far in excess of the number of adhesive pads 56, are then placed onto the bottom glass plate 12 and the plate is moved to roll the beads and ensure that one bead adheres to each adhesive pad 56. The plate 12 is then turned sideways or upside down so that those spacer members 16 which did not adhere fall from the plate 12 for later use.

The plate 12 is then placed in an environment to permanently affix the spacer members 16 to the pads 56. This may be an air dry environment, heat treatment step or some other annealing step. In the embodiment in which the adhesive pads 56 is composed of a binder and glass, the treatment step is preferably a heat treatment step of a sufficient temperature to melt the glass in the adhesive pad sufficient that it binds with both the lower glass plate 12 and the spacer members 16 but does not cause substantially melting of either the beads or the plate 12. The temperature is then lowered, making the glass in the adhesive pads 56 rigid and solidly fusing the spacer members 16 to the respective pads 56 on the plate 12. The heating step also serves to drive out the binders from the adhesive pad so that the interior surface is composed generally of glass and the desired light emitting materials such as the phosphors and the other gasses.

In one embodiment, the phosphor is applied first to plate 12 after which the pads 56 and glass beads are affixed to the plate 12 as has been described. In an alternative embodiment, the sequence of steps is changed so that the glass spacer members 16 are affixed to the plate 12 after which the phosphor layer 52 is adhered to the plate 12 and to the spacer members 16.

Coating the plate 12 with the spacer members 16 attached is done without a mask and provides a blanket covering of all exposed surfaces, including the spacer members 16. This sequence has the advantage of using one less mask and the screen printing for the pads 56 does not need to be aligned with the openings in a phosphor layer, since one is not present when they are applied. The phosphor layer is applied with the glass beads present, which is more difficult than with a flat surface on plate 12, so there are advantages to either approach.

The process may be done in either sequence according to principles of the present invention. The upper glass plate 14 on the sidewall spacer 18 is then affixed to the lower glass plate 12 to create a hermetically sealed chamber 20. The atmosphere, which at this stage of the process will normally be ambient air, is removed from the chamber. This is preferably removed using some vacuum nipple or tubing but other methods of removing the atmosphere are acceptable, such as assembling the final lamp inside a vacuum or other acceptable techniques. When the air is being evacuated from the chamber 20, the upper plate 14 will be drawn towards the bottom glass plate 12 so as to be supported by and in contact with the glass spacer members 16. The spacer members 16 serve to support the upper plate 14 and prevent breakage thereof while the vacuum is drawn in the chamber 20. This permits large plates to be used of hundreds of square inches without fear of breakage. After the atmosphere has been withdrawn, the desired gas and vapor mixture is placed into the chamber 20 so that it emits light when an electric voltage is applied between plates 22 and 24 as is previously described herein. When the emissive gas is placed inside the chamber 20 it may cause the plates 14 and 12 to be pushed away from each other and, in the event it exceeds one atmosphere a pressure will be created forcing the plates apart from each other. Since the plate 14 rests on the spacer members 16 but is not affixed to them, the plate 14 is permitted to flex outward during the gas refill process without causing breakage of the lamp.

According to a preferred embodiment, the gas pressure inside the lamp is approximately 75% of atmospheric pressure although in some embodiments, the pressure may exceed atmospheric pressure by several atmospheres or, may remain a partial vacuum of a tenth of an atmosphere or less. Accordingly, the glass spacer beads serve the dual function of preventing implosion of the chamber 20 by keeping glass plates 14 and 12 spaced a distance apart when a vacuum is drawn, while at the same time permitting some flexing of the plates relative to each other as the air pressure changes. Flexing may also be present between the plates during operation of the lamp as may be caused by local heating effects. While the heat output by a florescent lamp is relatively small, there may nevertheless be some differences in the coefficients of expansion between various materials in the lamp and having the glass spacer members 16 rigidly affixed to one plate while not rigidly affixed to the other plate permits the plates to move relative to each other while maintaining integrity of the lamp. If care is taken to ensure matching thermal coefficients of expansion between all materials and a pressure not greater than atmospheric is used, it is permitted in one embodiment to also fuse or adhere the spacer members 16 to both plates, the bottom plate 12 and the top plate 14.

Figure 4B:
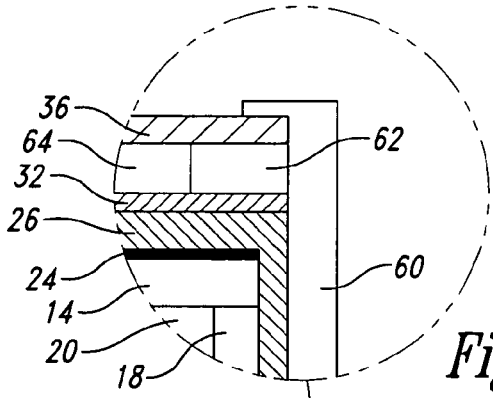
FIG. 4*b* is a cross-sectional view of an enlarged portion within FIG. 4*a* in an alternative embodiment.

FIG. 4 shows a cross-sectional view of the different layers of the invention. As shown, the glass spacer members 16 are affixed to the bottom glass plate 12 via adhesive pads 56. Extending over the surface of the bottom glass plate 12 is bottom electrode 22. Extending over the bottom electrode 22 is the insulating layer 26. The layer over the insulating layer 26 is an optional bottom supportive layer 30, which is in contact with the outermost layer, a bottom decorative logo layer 34.

Symmetrically, the top glass plate 14, which is not affixed to glass spacer beads 14, is covered by top electrode 24. Top electrode 24 is in contact with the insulating layer 26. Extending over the surface of the insulating layer 26 is an optional top supportive layer 32. On the exterior of the device is a decorative logo layer 36. As shown, sidewall spacer 18 creates the hermetic seal with bottom glass plate 12 and top glass plate 14 to create the chamber 20.

A retaining rim 60 wraps around all layers of the device, including the outermost logo layers 34, 36. This retaining rim 60 functions to keep the decorative logo layers 34, 36 physically in place. The rim 60 may be designed as a plastic lip or other simple mechanical securing apparatus, such that it may be easily removed and the decorative logo layers 34, 36 may be easily switched with different layers having a different design thereon.

Figure 4A:
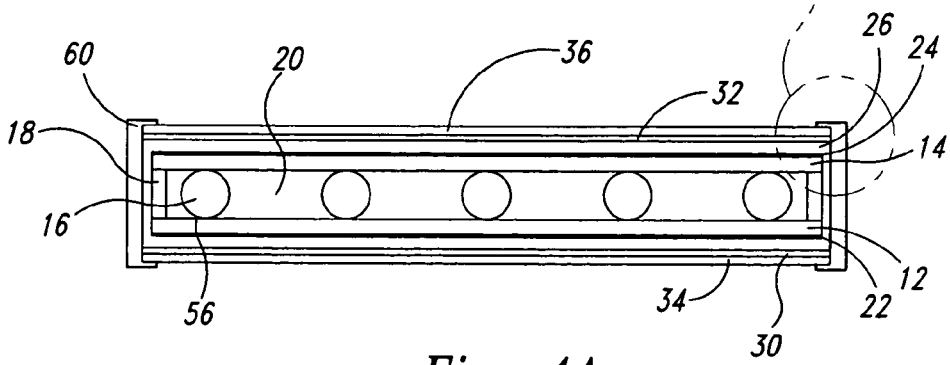
FIG. 4*a* is a side elevation, partial cross-sectional view of the different layers of the invention.

FIG. 4*a* shows an enlarged section from FIG. 4 according to one alternative embodiment. A spacer ring 62 is provided between support layer 32 and the logo layer 36. The spacer ring 62 creates an air gap 64 between ring 62, the logo layer 36 and the rest of the lamp 10. The air gap 64 will provide some noise isolation and make the lamp much quieter. Some fluorescent lamps may have a buzz, and this air gap provides some noise damping and results in a much quieter lamp. The logo layer 36 may be made thicker and much stiffer in this embodiment to be self-supporting and maintain the air gap across the entire face of the lamp.

Figure 5:
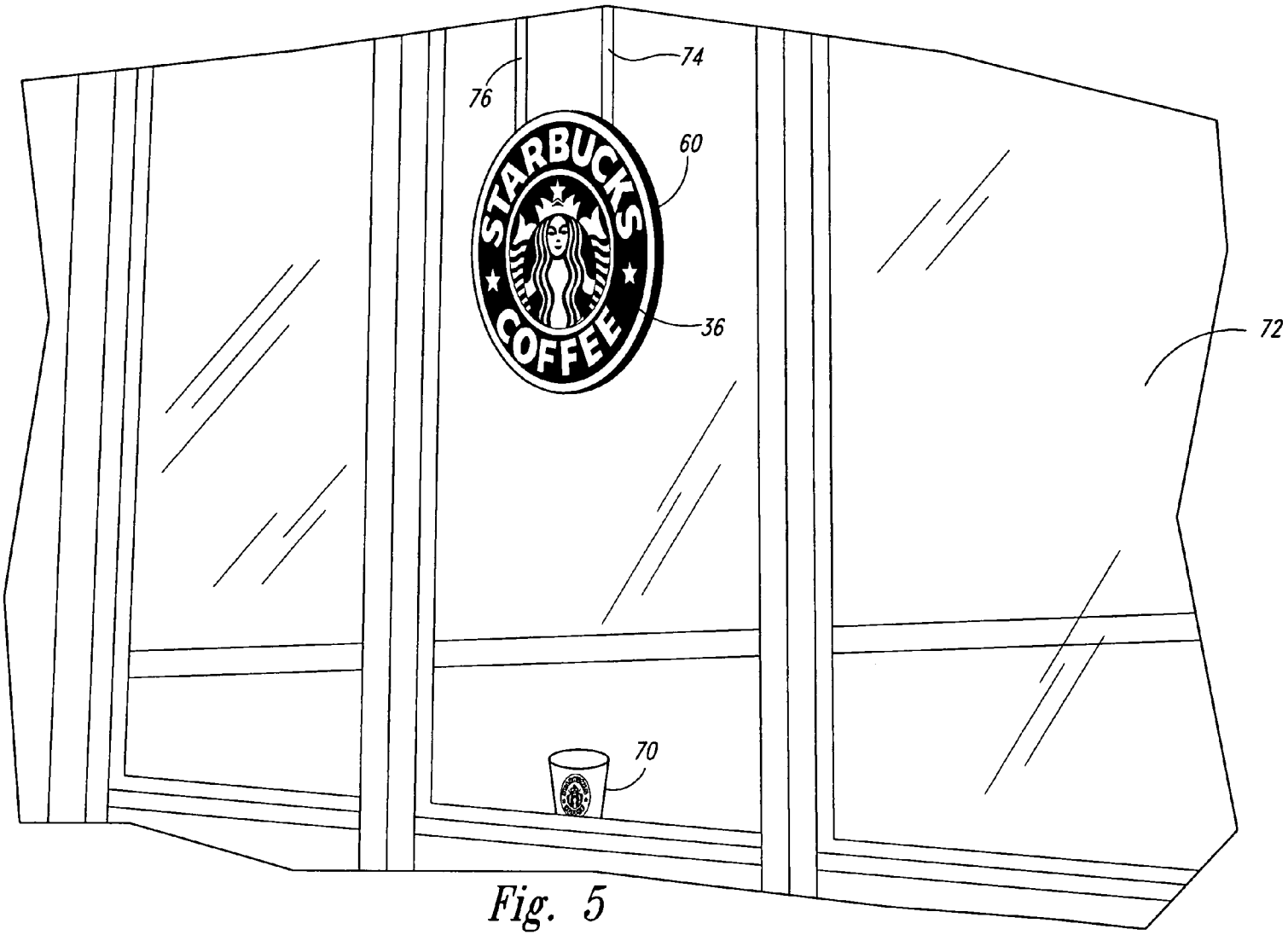
FIG. 5 is a perspective view of one practical application of an embodiment of the invention.

FIG. 5 shows a perspective view of an application of an embodiment of the invention, showing the lamp as it may be used. The retaining rim 60 is shown to hold in place the decorative logo layer 36, which depicts the advertising logo Starbucks Coffee®. As shown, the sign is hung by two cables 74, 76, but in an alternate embodiment may be hung by one supporting cable. Alternatively, the sign can be used on a stand or rotating display. As depicted, the thickness of the lamp is less than a typical beverage cup 70.

The lamp is functional as a two-sided advertising mark. Thus, an advertising sign may act as a display to the outside through a window 72 in a store as well as to the inside of the store. It will be appreciated that different decorative and advertising logos may be placed on either side of the lamp, and may be easily replaced. While a typical lamp may be 15" in diameter and circular, the size and shape can be selected as desired. Lamps as small as 3–5 inches in diameter and as large as 100 inches in diameter and larger could easily be used. This technology is not limited to the footprint or shape of the lamp and thus is ideal for a myriad of lighting environments. Resolution and uniformity of light output is unaffected by the shape or size of the display, so even large or odd shaped displays can be created.

From the foregoing it will be appreciated that, although specific embodiments of the invention have been described herein for purposes of illustration, various modifications may be made without deviating from the spirit and scope of the invention. Accordingly, the invention is not limited except as by the appended claims.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

What is claimed is:

1. A gas-filled thin-profile photoluminescent lamp comprising:

a first planar glass plate;

a plurality of glass beads affixed to the first glass plate at selected positions in a pattern;

a second planar glass plate positioned on top of the glass spacer beads, the second glass plate being supported by the plurality of glass beads;

a sidewall affixed to each of the first and second glass plates, the sidewall forming a seal with each of the first and second glass plates to form a hermetic chamber;

a selected gas within the hermetic chamber;

a first transparent electrode positioned on an outer surface of the first glass plate;

a second transparent electrode positioned on an outer surface of the second glass plate, the hermetic chamber and the gas being located between the first and second transparent electrodes, in a manner that the first and second transparent electrodes can generate an electric field to interact with the gas therebetween in the hermetic chamber to produce visible light;

a first transparent electrically insulating layer extending over the first electrode;

a second transparent electrically insulating layer extending over the second electrode;

a first semi-transparent decorative layer positioned over the first electrically insulating layer; and a plurality of adhesive pads positioned between the plurality of glass beads and the first glass plate to affix the beads to the first glass plate, wherein the plurality of adhesive pads are composed of a glass having a relatively low melting point as compared to a melting point of the first glass plate and the plurality of glass beads.

2. The lamp according to claim 1, further comprising:

a first structurally supportive layer between the first insulating layer and the first semi-transparent decorative layer.

3. The lamp according to claim 1, further comprising:

a reflective layer applied to a surface of the second planar glass plate to reflect the visible light.

4. The lamp according to claim 1 wherein said first and second insulating layers are comprised of silicone.

5. The lamp according to claim 1 wherein said first and second electrodes are a transparent conductive coating on the first and second glass plates.

6. The lamp according to claim 1 wherein both the first and second transparent electrically insulating layers comprise at least one transparent layer through which passes the visible light that is produced by the interaction the electrical field generated by the first and second transparent electrodes and the gas therebetween.

7. The lamp according to claim 1 wherein said first and second transparent electrodes comprise conductive lines.

8. The lamp according to claim 1, further comprising:

a second semi-transparent decorative layer positioned over the second electrically insulating layer.

9. The lamp according to claim 8 wherein said first and second semi-transparent decorative layers are advertising images silk-screened onto a supportive backing.

10. The lamp according to claim 9, further comprising:

a retaining rim around a thin-profile outer edge of the lamp for holding the advertising images in a fixed position.

11. A method of constructing a gas-filled thin-profile photoluminescent lamp, the method comprising:

affixing a plurality of adhesive pads to a first glass plate in a selected pattern, wherein said adhesive pads are composed of an adhesive binder and a low melting point glass;

placing a plurality of glass beads in contact with the first glass plate, the number of glass beads exceeding the number of adhesive pads;

moving the plurality of glass beads along the surface of the first glass plate causing the glass beads to adhere to the adhesive pads;

treating the first glass plate, plurality of glass beads. and adhesive pads in order to permanently affix the glass beads to the first glass plate;

placing a second glass plate on top of the plurality of glass beads, the second glass plate resting on the plurality of glass beads;

affixing the first plate to the second plate with a hermetic seal so as to create a chamber;

evacuating an atmosphere from the chamber;

filling the chamber with a selected gas at a pressure;

applying first and second transparent electrodes to the first and second glass plates, respectively, in a manner that the chamber and gas are located between the first and second transparent electrodes to permit the first and second transparent electrodes, if energized, to create an electric field inside of the chamber that can interact with the gas between the first and second transparent electrodes for the generation of photoluminescent light by the thin-profile lamp; and applying first and second electrically insulating layers over the first and second electrodes.

12. The method of claim 11 wherein applying first and second electrically insulating layers includes:

dipping the first and second transparent electrodes into silicone, to apply a thin layer of about 1 mm of insulation on the exterior of the device.

13. The method of claim 11, further comprising:

applying a first structurally supportive layer over an exterior of the first electrically insulating layer.

14. The method of claim 13, further comprising:

applying a first semi-transparent decorative layer over an exterior of the first structurally supportive layer.

15. A method of constructing a gas-filled thin-profile photoluminescent lamp, the method comprising:

affixing a plurality of adhesive pads to a first glass plate in a selected pattern;

placing a plurality of glass beads in contact with the first glass plate, the number of glass beads exceeding the number of adhesive pads;

moving the plurality of glass beads along the surface of the first glass plate causing the glass beads to adhere to the adhesive pads:

treating the first glass plate, plurality of glass beads, and adhesive pads in order to permanently affix the glass beads to the first glass plate, wherein treating the first glass plate, plurality of glass beads, and adhesive pads includes: heating the glass plate, beads, and adhesive pads to a temperature sufficient to melt glass in the adhesive pads, thereby fusing the glass beads to the glass plate with low melting point glass;

placing a second glass plate on top of the plurality of glass beads, the second glass plate resting on the plurality of glass beads;

affixing the first plate to the second plate with a hermetic seal so as to create a chamber;

evacuating an atmosphere from the chamber;

filling the chamber with a selected gas at a pressure;

applying first and second transparent electrodes to the first and second glass plates, respectively, in a manner that the chamber and gas are located between the first and second transparent electrodes to permit the first and second transparent electrodes, if energized, to create an electric field inside of the chamber that can interact with the gas between the first and second transparent electrodes for the generation of photoluminescent light by the thin-profile lamp; and applying first and second electrically insulating layers over the first and second electrodes.

16. A gas-filled photoluminescent lamp, comprising:

a first planar glass plate;

a plurality of glass beads affixed to the first glass plate at selected positions in a pattern;

a second planar glass plate positioned on top of the glass spacer beads, the second glass plate being supported by the plurality of glass beads;

a plurality of adhesive pads positioned between the plurality of glass beads and the first glass plate to affix the beads to the first glass plate, wherein the plurality of adhesive pads include a glass material having a relatively low melting point as compared to a melting point of the first glass plate and of the plurality of glass beads;

a sidewall affixed to each of the first and second glass plates, the sidewall forming a seal with each of the first and second glass plates to form a hermetic chamber;

a gas within the hermetic chamber;

a first transparent electrode positioned on an outer surface of the first glass plate;

a second transparent electrode positioned on an outer surface of the second glass plate;

a first transparent electrically insulating layer extending over the first electrode;

a second transparent electrically insulating layer extending over the second electrode; and a first semi-transparent decorative layer positioned over the first electrically insulating layer.

17. A method of constructing a gas-filled thin-profile photoluminescent lamp, the method comprising:

affixing a plurality of adhesive pads to a first glass plate in a selected pattern;

placing a plurality of glass beads in contact with the first glass plate, the number of glass beads exceeding the number of adhesive pad;

moving the plurality of glass beads along the surface of the first glass plate causing the glass beads to adhere to the adhesive pads;

treating the first glass plate, plurality of glass beads, and adhesive pads in order to permanently affix the glass beads to the first glass plate;

placing a second glass plate on top of the plurality of glass beads, the second glass plate resting on the plurality of glass beads to form a top plate of glass;

affixing the first plate to the second plate with a hermetic seal so as to create a chamber;

evacuating an atmosphere from the chamber;

filling the chamber with a selected gas at a pressure, wherein evacuating the atmosphere from the chamber and filling the chamber with the selected gas include: permitting the top plate of glass to flex away from the beads at selected locations;

applying first and second transparent electrodes to the first and second glass plates, respectively, in a manner that the chamber and gas are located between the first and second transparent electrodes to permit the first and second transparent electrodes, if energized, to create an electric field inside of the chamber that can interact with the gas between the first and second transparent electrodes for the generation of photoluminescent light by the thin-profile lamp; and applying first and second electrically insulating layers over the first and second electrodes.

* * * * *